US009382651B2

(12) United States Patent
Lee et al.

(10) Patent No.: US 9,382,651 B2
(45) Date of Patent: Jul. 5, 2016

(54) WASHING MACHINE

(71) Applicants: Kilryong Lee, Changwon-si (KR); Heunggi Kim, Changwon-si (KR)

(72) Inventors: Kilryong Lee, Changwon-si (KR); Heunggi Kim, Changwon-si (KR)

(73) Assignee: LG ELECTRONICS INC., Seoul (KR)

( * ) Notice: Subject to any disclaimer, the term of this patent is extended or adjusted under 35 U.S.C. 154(b) by 115 days.

(21) Appl. No.: 13/706,563

(22) Filed: Dec. 6, 2012

(65) Prior Publication Data

US 2013/0145799 A1 Jun. 13, 2013

(30) Foreign Application Priority Data

Dec. 9, 2011 (KR) ..... 10-2011-0131963

(51) Int. Cl.
*D06F 37/02* (2006.01)
*D06F 21/00* (2006.01)
*D06F 37/26* (2006.01)

(52) U.S. Cl.
CPC ..... *D06F 21/00* (2013.01); *D06F 37/26* (2013.01); *D06F 37/261* (2013.01)

(58) Field of Classification Search
CPC ..... D06F 37/02
See application file for complete search history.

(56) References Cited

U.S. PATENT DOCUMENTS 3,932,947 A 1/1976 Smoot ..... 34/242
4,007,546 A 2/1977 Sauer ..... 34/133
4,423,607 A * 1/1984 Munini ..... D06F 37/20 220/675
6,539,753 B1 * 4/2003 Ito ..... D06F 23/06 68/140
2006/0010613 A1 1/2006 Jeon et al.
2007/0169521 A1 7/2007 Kim et al.
2008/0250824 A1 10/2008 Oh et al.
2011/0232336 A1 * 9/2011 Hong et al. ..... 68/140

FOREIGN PATENT DOCUMENTS

| | | | |
|---|---|---|---|
| CN | 101008147 | A | 8/2007 |
| DE | 25 05 917 | | 8/1976 |
| EP | 2 392 719 | A1 | 12/2011 |
| JP | 10-211393 | A | 8/1998 |
| WO | WO 2004/042133 | A1 | 5/2004 |
| WO | WO 2006/120644 | A1 | 11/2006 |
| WO | WO 2010/010114 | A2 | 1/2010 |
| WO | WO 2011/105829 | A2 | 9/2011 |

OTHER PUBLICATIONS

Russian Office Action dated Mar. 18, 2014, issued in Application No. 2012153050/12 (with English Translation).
Australian Office Action dated Jul. 2, 2013.
Chinese Office Action dated Aug. 5, 2014, issued in Application No. 201210528220.2.
Chinese Office Action dated Mar. 12, 2015 (English Translation).

* cited by examiner

*Primary Examiner* — Jason Ko
(74) *Attorney, Agent, or Firm* — Ked & Associates, LLP

(57) ABSTRACT

A washing machine is provided. The washing machine may include a cabinet and a tub. The cabinet may define an exterior of the washing machine. The tub may be disposed inside the cabinet to hold wash water. The tub may have a cross-section on which a first length passing through a central longitudinal axis of the tub and extending from a first side to a second side along a first direction, which is substantially horizontal, may be shorter than a second length passing through the central longitudinal axis of the tub and extending from a third side to a fourth side along a second direction, which is perpendicular to the first direction.

20 Claims, 5 Drawing Sheets

WASHING MACHINE

CROSS-REFERENCE TO RELATED APPLICATION(S)

This application claims priority to Korean Patent application No. 10-2011-0131963 filed in Korea on Dec. 9, 2011, which is hereby incorporated by reference.

BACKGROUND

1. Field

A washing machine is disclosed herein.

2. Background

Washing machines are known. However, they suffer from various disadvantages.

BRIEF DESCRIPTION OF THE DRAWINGS

Embodiments will be described in detail with reference to the following drawings in which like reference numerals refer to like elements, and wherein.

DETAILED DESCRIPTION

Figure 1:
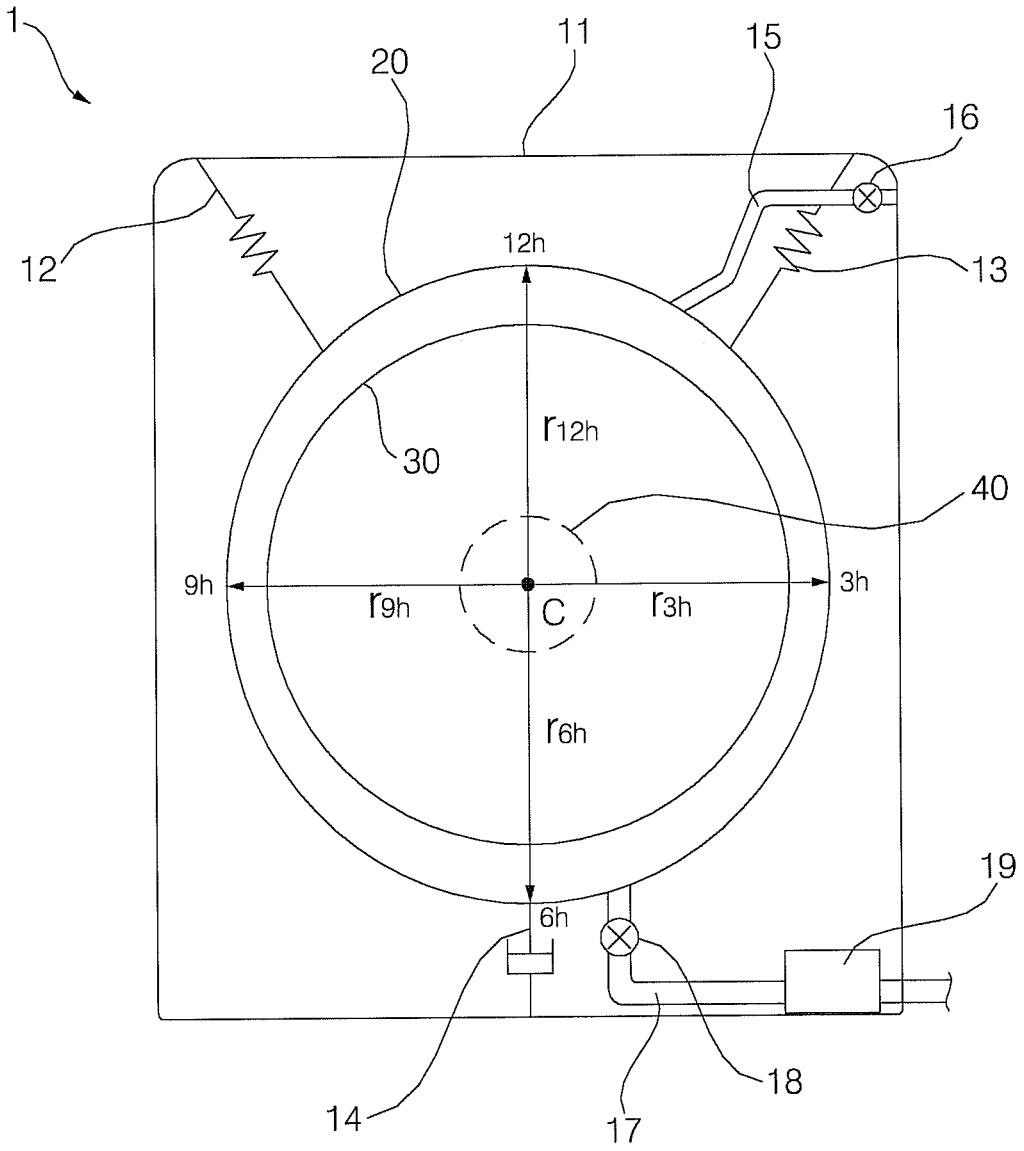
FIG. 1 is a schematic front view of a washing machine according to an embodiment.

The foregoing and other objects, features, aspects and advantages will become more apparent from the following detailed description when taken in conjunction with the accompanying drawings. Exemplary embodiments will now be described in detail with reference to the accompanying drawings. Embodiments may, however, be embodied in many different forms and should not be construed as being limited to the embodiments set forth herein. Rather, the exemplary embodiments are provided so that this disclosure will be thorough and complete, and will fully convey the scope to those skilled in the art. In the drawings, the shapes and dimensions may be exaggerated for clarity, and the same reference numerals will be used throughout to designate the same or like components.

In general, a washing machine is an apparatus that uses water, detergent, and mechanical action to wash, for example, clothing, bed linen, etc. (hereinafter referred to as 'laundry') by performing wash, rinse, and spin cycles to remove contaminants from the laundry. Washing machines may be categorized as top loading type and front loading type washing machines according to a laundry loading type.

In front loading type washing machines, a tub may be disposed so as to be rotatable about a horizontal axis, and laundry loaded from a front side. For example, the front loading type washing machine may include a drum washing machine in which laundry is tumbled by a drum rotating about the horizontal axis during washing. A drum washing machine may include a tub installed inside a cabinet that defines an exterior of the washing machine, that holds wash water, and a drum disposed inside the tub to hold laundry, on which wash, rinse, and spin cycles may be performed.

Recently, demands for washing machines that can treat a larger amount of laundry at one time are increasing, but simply expanding a size of a washing machine to meet such demands has limitations in terms of a space in which the washing machine is installed.

FIG. 1 is a view of a washing machine according to an embodiment. Referring to FIG. 1, the washing machine 1 may include a cabinet 11 that defines an exterior thereof, a tub 20 disposed inside the cabinet 11 to hold wash water, and a drum 30 that rotates inside of the tub 20.

A water supplying passage 15 may be provided that supplies wash water into the tub 12. The water supplying passage 15 may be equipped with a water supplying valve 16 that controls a flow of the wash water.

The tub 20 may be spaced from inner side surfaces of the cabinet 11, and may be supported by, for example, suspensions 12 and 13 and/or a damper 14. In this embodiment, although the tub 20 is supported by the suspensions 12 and 13 disposed at two upper portions thereof and the one damper 14 disposed at a lower portion thereof, embodiments are limited thereto. That is, the tub may be supported by any arrangement, as long as the tub 20 is spaced from the inner side surfaces of the cabinet 11 and vibration of the tub 20 absorbed.

A water exhausting passage 17 may be provided, that exhausts wash water out of the washing machine 1. The water exhausting passage 17 may be provided with a water exhausting valve 18 that controls the flow of wash water and a pump 19 that pumps wash water.

A motor 40 may provide a driving force that rotates the drum 30. Methods for delivering the driving force provided by the motor 40 may be classified into a direct driving method and an indirect driving method. In the direct driving method, a rotational axis of the motor 40 may be directly coupled to the drum 30, and the rotational axis of the motor 40 and the rotational axis of the drum 30 may be coaxially disposed. The motor 40 of FIG. 1 is an example of the direct driving method, where the motor 40 is disposed between a rear side of the tub 20 and the cabinet 11.

In the indirect driving method, the driving force provided by the motor 40 may rotate the drum 30 via a power delivery member, such as a belt or a pulley. Alternatively, tubs 20, 120, and 220 described hereinbelow may be driven by the indirect driving method. In case of the direct driving method, since there is a limitation in increasing a longitudinal length of the drum 30 or the tub 20 due to structural limitations of the position of the motor 40, there is a greater need to enlarge the capacity by enlarging a radius of the drum 30 or the tub 20 or improve space utilization between the tub 20 and the cabinet 11, than in the case of the indirect driving method.

The washing capacity is directly related to the capacity of the drum, but the capacity of the tub also needs to increase to enlarge the capacity of the drum. Methods for enlarging the capacity of the tub described hereinbelow are closely related to the enlargement of the drum capacity and the washing capacity.

The tub 20 of FIG. 1 according to this embodiment has a first length in a first direction passing through a central longitudinal axis C of the tub 20 and extending substantially horizontally on a certain cross-section substantially orthogonal to the central longitudinal axis C of the tub, and a second length in a second direction passing through the central longitudinal axis C of the tub 20 and extending substantially vertically on the certain cross-section. The first length may be shorter than the second length. Hereinafter, referring to FIG. 1, the first length may be defined as a horizontal length connecting a point 9*h* to a point 3*h*, and the second length may be defined as a vertical length connecting a point 12*h* to a point 6*h*.

As the tub 20 has a certain thickness, a radius of the tub 20 may be defined as either a distance from the central longitudinal axis C of the tub 20 to an inner side surface of the tub 20 or a distance from the central longitudinal axis C of the tub 20 to an outer side surface of the tub 20. Hereinafter, for convenience of explanation, the radius of the tub 30 may be defined as the distance from the central longitudinal axis C of the tub 20 to the outer side surface of the tub 20.

Embodiments disclosed herein improve space utilization in the cabinet 11 in consideration of structural characteristics of the cabinet 11, in which the vertical length is longer than the horizontal length. In this regard, since the tub 30 has the vertical radius r12*h* and r6*h* greater than the horizontal radius r3*h* and r9*h*, a capacity of the tub 20 may be enlarged though space utilization in the vertical direction inside the cabinet 11, and an interval between an outer side surface of the tub 20 and inner side surfaces of the cabinet 11 may be secured to prevent the tub 20 from colliding with the cabinet 11 even when vibration occurs during rotation of the drum 30. Here, collision with the cabinet 11 due to vertical vibration of the tub 20 has not been considered. This is because the vertical vibration of the tub 20 may be directly absorbed by the suspensions 12 and 13 or the damper 14, and a relatively sufficient space is vertically provided in the cabinet 11, in which to dispose apparatuses, such as the suspensions 12 and 13, the damper 14, a detergent box (not shown), and a water supply apparatus (not shown). Accordingly, although the vertical radius of the tub 20 is enlarged, collision with the cabinet 11 may not occur upon vibration of the tub 20.

In FIG. 1, the radius of the tub 20 is shown as the distance from the central longitudinal axis C of the tub 20 to the outer side surface of the tub 20. In order for the tub 20 not to collide with the inner side surface of the cabinet 11 when the tub 20 vibrates, an interval between the outer side surface of the tub 20 and the inner side surface of the cabinet 11 may be secured. Accordingly, it will be noted that the terms radius, diameter, and vertical and horizontal widths of the tub 20 described hereinbelow are all based on the outer side surface of the tub 20. Generally, since the side walls of the tub 20 has a thickness of several mm, for example, about 1 cm or less, there is no substantially significant difference even though the above-mentioned dimensions are defined based on the inner side surface of the tub 20. However, since structures, such as a rib projecting from the outer side surface of the tub 20 for stiffness reinforcement, has a thickness of about 1 cm or more, a reinforcing part, such as a rib, may not be disposed at closest portions (3*h* and 9*h* of FIG. 1) to the cabinet 11. To secure a sufficient interval between the outer side surface of the tub 20 and the cabinet 11, a projection length of the rib may also be considered herein.

A curvature of the tub 20 may vary in a circumferential direction. More particularly, the curvature may be greater at upper and lower sides than at right and left sides. For example, FIG. 1 illustrates the tub 20 having a greater curvature at the points 12*h* and 6*h* than at the points 3*h* and 9*h*. The curvature of the tub 20 may continuously change along the circumference thereof, and the curvature may have a maximum value at the points 12*h* and 6*h* and a minimum value at the points 3*h* and 9*h*. With this structure, the tub has an oval sectional shape with a longer radius r12*h* and r6*h* and a shorter radius r3*h* and r9*h*. The shorter radius of the tub 20 may face a lateral direction of the cabinet 11.

Figure 2:
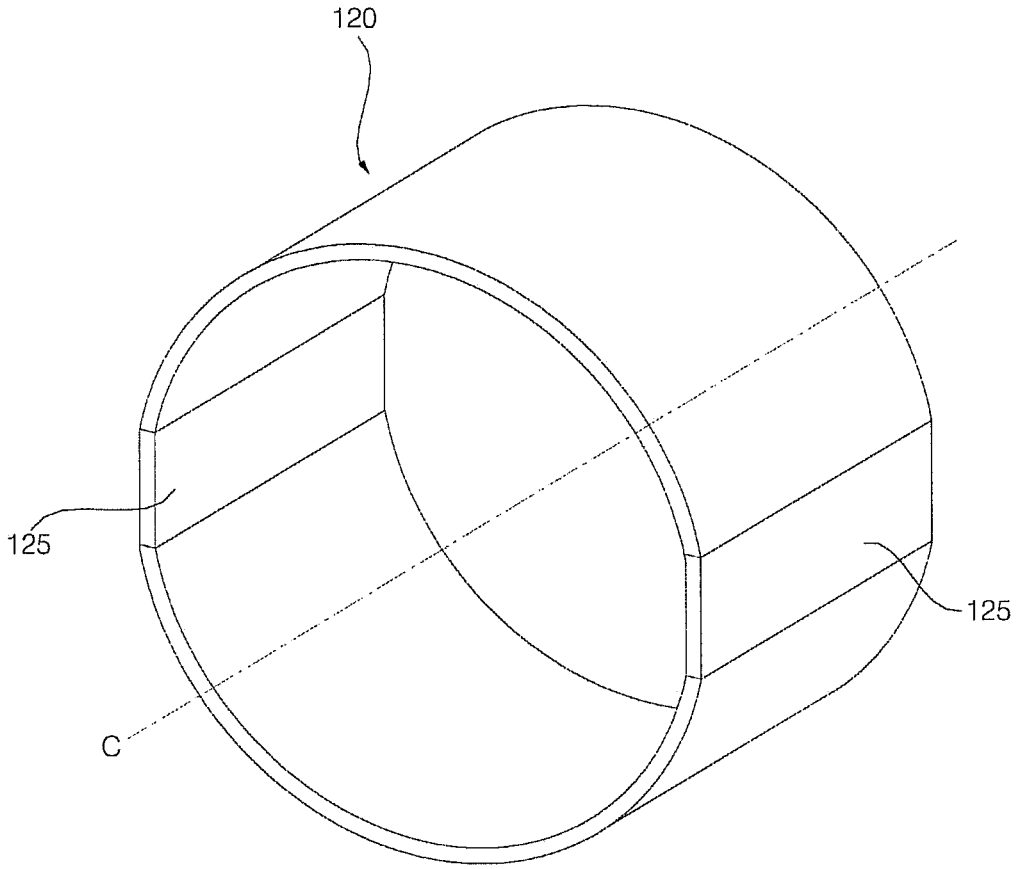
FIG. 2 is a perspective view of a tub according to an embodiment.
Figure 3:
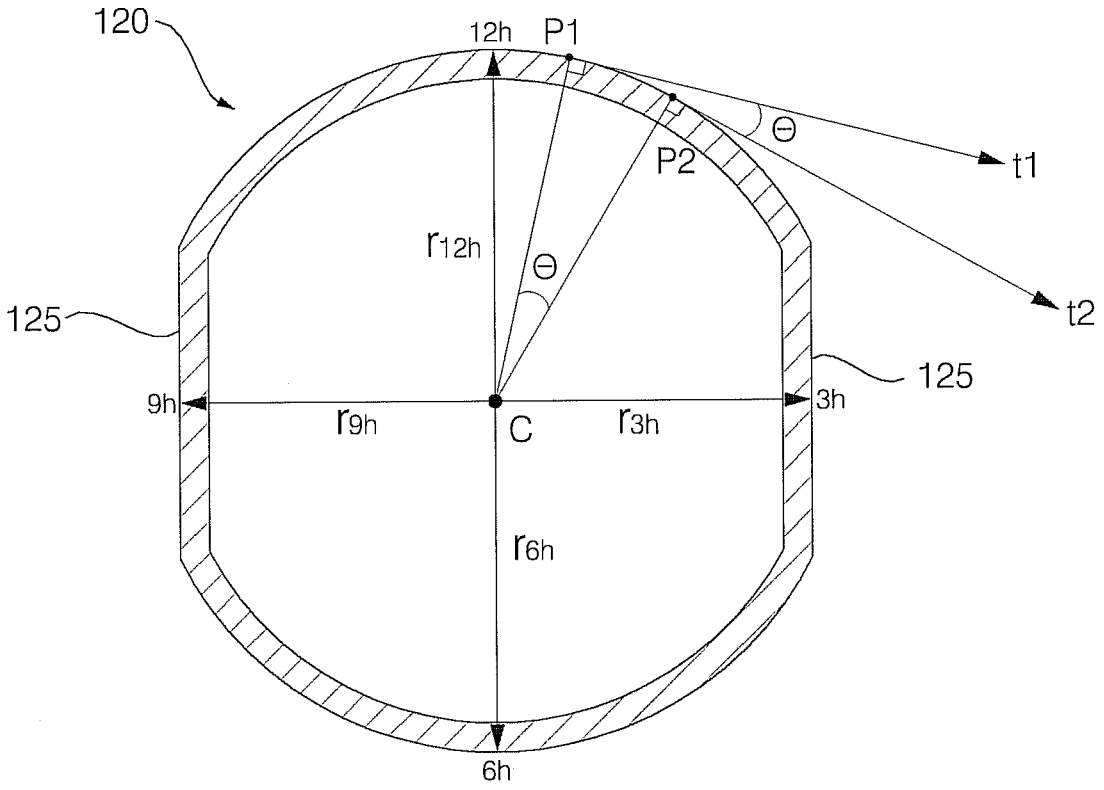
FIG. 3 is a cross-sectional view of the tub of FIG. 2.

FIG. 2 is a perspective view of a tub according to another embodiment. FIG. 3 is a cross-sectional view of the tub of FIG. 2.

A tub 120 according to this embodiment may have a planar surface(s) 125 on an outer side surface thereof. At least one of points 3*h* and 9*h* at which a straight line extending along the first direction (3*h*-9*h*) meets the outer side surface of the tub 120 may be located on the planar surface(s) 125.

The radius of the tub 120 may become minimal on the planar surface(s) 125. Accordingly, a horizontal radius $r_{3h}$ and $r_{9h}$ of the tub 120 may be smaller than a vertical radius $r_{12h}$ and $r_{6h}$ of the tub 120. In this case, similarly to the previous embodiment, collision of the tub 120 with the cabinet 11 may be prevented while improving vertical space utilization inside the cabinet 11. For example, as shown in FIG. 3, the tub 120 may have planar surfaces ($r_{12h}>r_{3h}$) at right and left sides based on a circular section thereof. In terms of workability, since the planar surfaces may be formed by slightly modifying an injection mold having a substantially regular circle (radius=$r_{12h}$) used for a typical tub, it may be advantageous to manufacture such a tub.

However, the tub 120 may have a same horizontal radius $r_{3h}$ and $r_{9h}$ and vertical radius $r_{12h}$ and $r_{6h}$. In this case, although the vertical radius is determined to be equal to the horizontal radius of the tub 120, the tub 120 may have a greater capacity than when having a regular circle having the same radius due to the influence of the planar surface(s) 125. The planar surface(s) 125 may extend vertically parallel to the inner side surface of the cabinet 11.

Although the cross-section of the tub 120 of FIG. 3 may have a uniform curvature at other locations except the planar surface(s) 125, embodiments are not limited thereto. For example, the curvature of the tub 120 may vary such that a space around a corner of the cabinet 11 may be further utilized. Points P1 and P2 of FIG. 3 are two points on the outer side surface of the tub 120, and lines t1 and t2 are tangent lines on the points P1 and P2.

Figure 4:
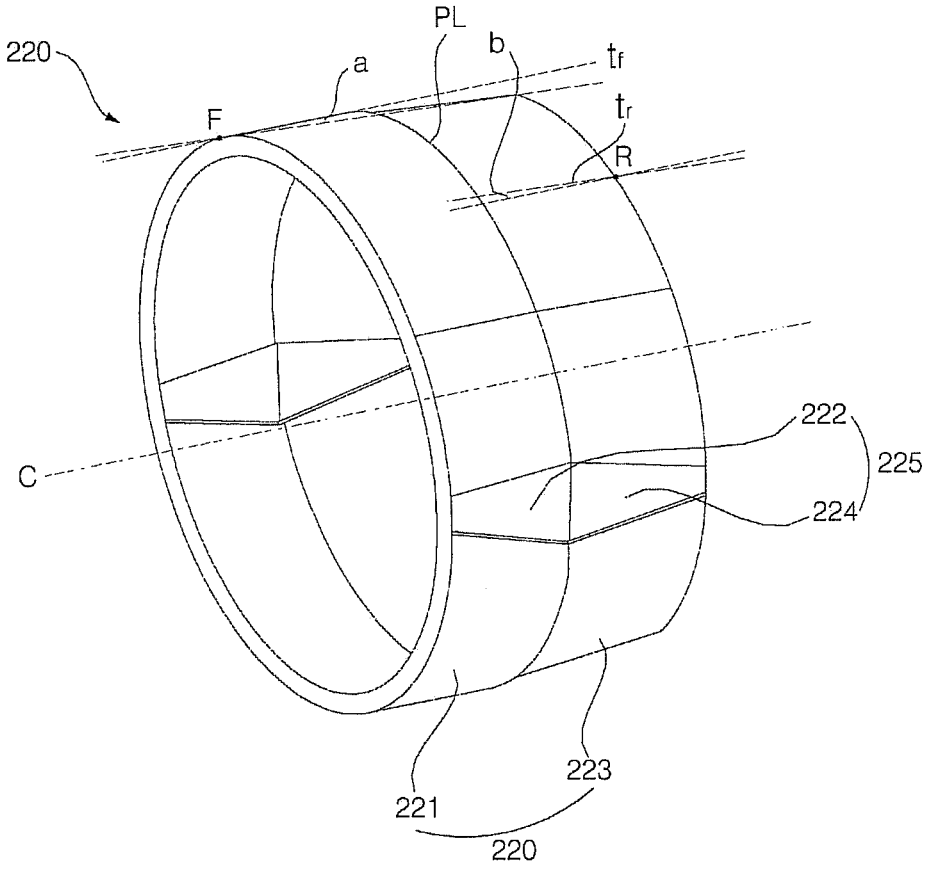
FIG. 4 is a perspective view of a tub according to another embodiment.
Figure 5:
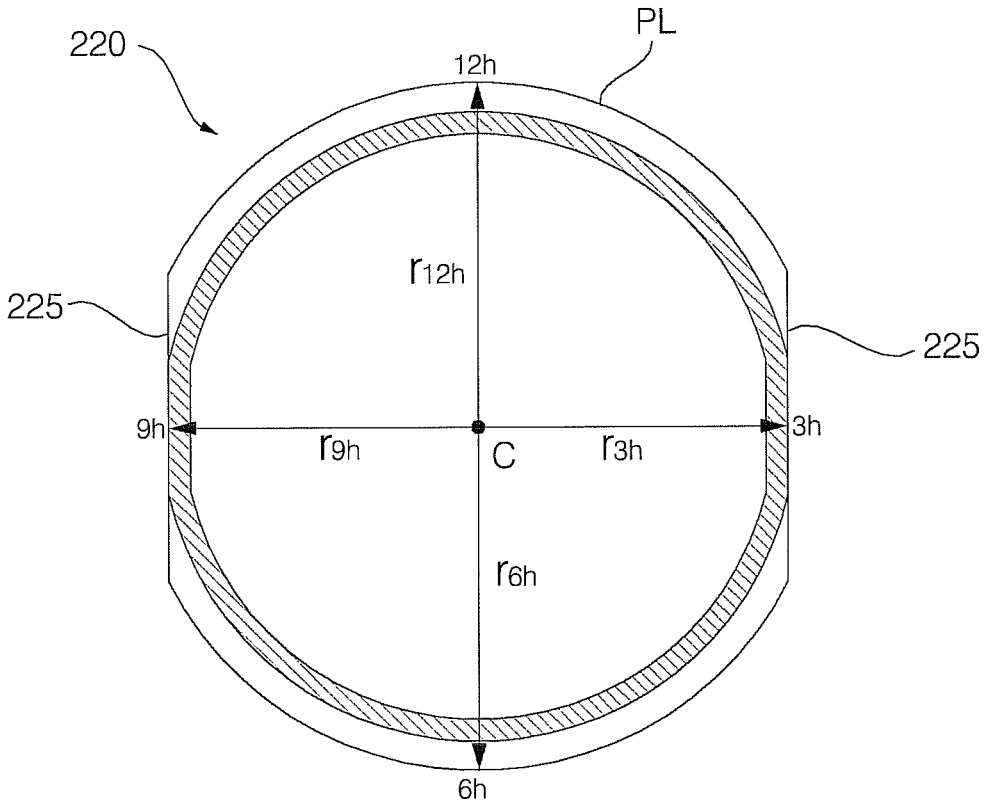
FIG. 5 is a front view of the tub of FIG. 4.

FIG. 4 is a perspective view of a tub according to another embodiment. FIG. 5 is a front view of the tub of FIG. 4.

Referring to FIGS. 4 and 5, a tub 220 may have a first tub member 221 disposed at a front side of the tub 220 and a second tub member 223 disposed at a rear side of the tub 220. A cross-section of the tub 220 of FIG. 4 may be similar to that shown in FIG. 3, but embodiments are not limited thereto. For example, the tub 220 may be formed by combining two tubs, which are divided into the front side and the rear side, and thus, the tub 220 may have a cross-section similar to those of the tubs of the previous embodiments described with reference to FIGS. 1 to 3 or derivatives thereof.

More particularly, the tub 220 according to this embodiment may have a planar surface(s) 225 similarly to the previous embodiment. A first portion 222 of the planar surface 225 may be formed on the first tub member 221, and a second portion 224 of the planar surface 225 may be formed on the second tub member 223.

The tub 220 may be formed by injection-molding. An outer side surface of the first tub member 221 and/or the second tub member 223 may be inclined in the longitudinal direction, such that demolding may be smoothly performed upon injection-molding. In this case, a bonding line PL, at which the first tub member 221 and the second tub member 223 meet, may be an outermost circumference of the tub 220. In FIG. 4, an angle a may be an angle between a tangent line tf on a front end of the first tub member 221 and a central longitudinal axis C, and an angle b may be an angle between a tangent line tr on a rear end of the second tub member 223 and the central longitudinal axis C.

The first planar portion 222 formed on the first tub member 221 of the planar surface 225 may have a minimum width at the front end of the first tub member 221, and may have a maximum width at the rear end defining the bonding line PL. The second planar portion 224 formed on the second tub member 223 may have a maximum width at the front end of the second tub member 223 defining the bonding line PL, and may have a minimum width at the rear end of the second tub member 223.

More specifically, due to the inclined shape of the first tub member 221 and/or the second tub member 223, a distance from the central longitudinal axis C of the tub 220 may become maximum at the bonding line PL at which the first tub member 221 and the second tub member 223 meet, and may become minimum at the front end of the first tub member 221 or the rear end of the second tub member 223. However, any point taken from the planar surface 225 may be spaced from a certain vertical plane that spans along a longitudinal direction of the tub 220 by the same distance, because at least one of the first tub member 221 or the second tub member 223 may be substantially parallel to the vertical plane.

The first tub member 221 and the second tub member 223 may be mutually coupled to each other by, for example, beading, but an interval between the tub 220 and the cabinet 11 may be reduced due to the projecting bonding line PL. Accordingly, the first tub 221 and the second tub member 223 may be coupled to each other by, for example, thermal bonding method. Even if the first tub 221 and the second tub member 223 are coupled by beading, the thermal bonding method may be performed at least on the planar surface(s) 225.

Although, according to embodiments, it has been described that the shape of the tub is vertically symmetrical ($r_{12h}=r_{6h}$) based on the horizontal line 3*h* to 9*h* and is horizontally symmetrical ($r_{3h}=r_{9h}$) based on the vertical line 12*h* to 6*h*, embodiments are not limited thereto, but may be modified within the scope to be described through each embodiment.

In the above disclosed embodiments, the tub may be formed to have a different vertical radius ($r_{12h}=r_{6h}$) and horizontal radius ($r_{3h}$ and $r_{9h}$). More particularly, the vertical radius ($r_{12h}=r_{6h}$) may be greater than the horizontal radius (r3*h* and r9*h*), such that the capacity of the tub may be enlarged through vertical space utilization inside the cabinet 11. In this case, a vertical diameter may be greater than a horizontal width of the cabinet 11.

Embodiments disclosed herein provide a washing machine, which may expand capacity by improving internal space utilization of a cabinet. Further, embodiments disclosed herein provide a washing machine, which may sufficiently deal with vibration generated during rotation of a drum while enlarging a capacity of the drum, and more particularly, may secure a sufficient absorbing space between a tub and a cabinet.

Embodiments disclosed herein provide a washing machine that may include a cabinet that defines an exterior of the washing machine, and a tub disposed inside the cabinet to hold wash water. The tub may have a cross-section for which a first length that passes a center of the tub and extends from one or a first side to the other or a second side along a first direction, which is substantially horizontal, may be shorter than a second length that passes the center of the tub and extends from one or a third side to the other or a fourth side along a second direction, which is substantially perpendicular to the first direction.

Embodiments disclosed herein further provide a washing machine that may include a cabinet that defines an exterior of the washing machine, and a tub disposed inside the cabinet to hold wash water. The tub may have a straight line section on at least a portion of a cross-section orthogonal to a longitudinal direction of the tub, and at least one of both points at which a straight line passing a center of the tub and extending along a first direction, which is substantially horizontal, meets an outer side surface of the tub is located on the straight line section.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A washing machine, comprising:

a cabinet that defines an exterior of the washing machine;

a tub disposed inside the cabinet that holds wash water, wherein the tub has a cross-section for which a first length that passes through a central longitudinal axis of the tub and extends from a first side to a second side along a first direction, which is substantially horizontal, is shorter than a second length that passes through the central longitudinal axis of the tub and extends from a third side to a fourth side along a second direction, which is perpendicular to the first direction, wherein the tub is spaced from inner side surfaces of the cabinet and supported by a suspension, wherein, at least one planar surface is formed on an outer side surface of the tub, wherein at least one of points at which a straight line that extends along the first direction meets the outer side surface of the tub is located on the at least one planar surface, wherein the tub includes:

a first tub member that forms a front portion of the tub; and a second tub member that forms a rear portion of the rub, which is coupled to the first tub member, wherein at least one of the first tub member or the second tub member is inclined in a longitudinal direction of the tub, wherein the at least one planar surface includes a first planar portion formed on the first tub member and a second planar portion formed on the second tub member, wherein the first planar portion has a minimum width at a front end of the first tub member and a maximum width at a rear end of the first tub member that defines a bonding line with the second tub member, and wherein the second planar portion has a minimum width at a rear end of the second tub member and a maximum width at a front end of the second tub member that defines the bonding line with the first tub member, wherein the maximum width at the front end of the second planar portion corresponds in size and location to the maximum width of the rear end of the first planar portion.

2. The washing machine of claim 1, wherein the cross-section of the tub has an oval shape for which the first length has a shorter radius and the second length has a longer radius.

3. The washing machine of claim 1, wherein the first length is a distance between points at which a straight line that extends along the first direction meets an outer side surface of the tub, and wherein the second length is a distance between points at which a straight line that extends along the second direction meets the outer side surface of the tub.

4. A washing machine, comprising:

a cabinet that defines an exterior of the washing machine; and a tub disposed inside the cabinet that holds wash water, wherein the tub includes a straight line section on at least a portion of a cross-section, which is substantially orthogonal to a longitudinal direction of the tub, wherein at least one of points at which a straight line that passes through a central longitudinal axis of the tub and extends along a first direction, which is substantially horizontal, meets an outer side surface of the tub is located on the straight line section, wherein the tub is spaced from inner side surfaces of the cabinet and supported by a suspension, wherein at least one planar surface is formed on an outer side surface of the tub, wherein at least one of points at which a straight line that extends along the first direction meets the outer side surface of the tub is located on the at least one planar surface, wherein the tub includes:

a first tub member that forms a front portion of the tub; and a second tub member that forms a rear portion of the tub, which is coupled to the first tub member, wherein at least one of the first tub member or the second tub member is inclined in a longitudinal direction of the tub, wherein the at least one planar surface includes a first planar portion formed on the first tub member and a second planar portion formed on the second tub member, wherein the first planar portion has a minimum width at a front end of the first tub member and a maximum width at a rear end of the first tub member that defines a bonding line with the second tub member, and wherein the second planar portion has a minimum width at a rear end of the second tub member and a maximum width at a front end of the second tub member that defines the bonding line with the first tub member, wherein the maximum width at the front end of the second planar portion corresponds in size and location to the maximum width of the rear end of the first planar portion.

5. The washing machine of claim 4, wherein a distance between the points at which the straight line extends along the first direction meets the outer side surface is substantially equal to a distance between points at which a straight line that extends along a second direction, which is substantially orthogonal to the first direction, meets the outer side surface of the tub.

6. The washing machine of claim 4, wherein the straight line section extends parallel to an inner side surface of the cabinet.

7. A washing machine, comprising a cabinet that defines an exterior of the washing machine; and a tub disposed inside the cabinet that holds wash water, wherein the tub has a cross-section orthogonal to a longitudinal direction of the tub having an oval shape, wherein a horizontal radius is shorter than a vertical radius, wherein the tub is spaced from inner side surfaces of the cabinet and supported by a suspension, wherein at least one planar surface is formed on an outer side surface of the tub, wherein at least one of points at which a straight line that extends along the first direction meets the outer side surface of the tub is located on the at least one planar surface, wherein the tub includes:

a first tub member that forms a front portion of the tub; and a second tub member that forms a rear portion of the tub, which is coupled to the first tub member, wherein at least one of the first tub member or the second tub member is inclined in a longitudinal direction of the tub, wherein the at least one planar surface comprises a first planar portion formed on the first tub member and a second planar portion formed on the second tub member, wherein the first planar portion has a minimum width at a front end of the first tub member and a maximum width at a rear end of the first tub member that defines a bonding line with the second tub member, and wherein the second planar portion has a minimum width at a rear end of the second tub member and a maximum width at a front end of the second tub member that defines the bonding line with the first tub member, wherein the maximum width at the front end of the second planar portion corresponds in size and location to the maximum width of the rear end of the first planar portion.

8. The washing machine of claim 7, wherein the at least one planar surface extends substantially parallel to the inner side surface of the cabinet.

9. The washing machine of claim 7, wherein the at least one planar surface extends substantially parallel to a vertical direction.

10. The washing machine of claim 7, wherein the bonding line, at which the first tub member and the second tub member meet, is an outermost circumference of the tub.

11. The washing machine of claim 10, wherein the at least one planar surface extends substantially parallel to an inner side surface of the cabinet.

12. The washing machine of claim 10, wherein the at least one planar surface extends substantially parallel to the second direction.

13. The washing machine of claim 11, wherein at least one of the first planar portion or the second planar portion extends substantially parallel to a vertical plane that extends along the longitudinal direction of the tub.

14. The washing machine of claim 13, wherein the first tub member and the second tub member are formed by injection-molding.

15. The washing machine of claim 14, wherein at least a portion of the bonding line formed by coupling of the first tub member and the second tub member is formed by thermal bonding.

16. The washing machine of claim 15, wherein the bonding line at at least adjacent the at least one planar surface is formed by the thermal bonding.

17. The washing machine of claim 15, wherein the tub further includes at least one rib that projects from the outer side surface to reinforce a strength thereof.

18. The washing machine of claim 17, wherein the at least one rib is disposed at portions except the at least one planar surface.

19. The washing machine of claim 18, further including:

a drum disposed in the tub; and a motor that rotates the drum, wherein the motor is disposed between a rear side of the tub and the cabinet.

20. The washing machine of claim 19, wherein the tub is connected to a damper at an upper side or a lower side thereof, respectively, that absorbs vibration.

* * * * *